US007057560B2

(12) United States Patent
Erkocevic

(10) Patent No.: US 7,057,560 B2
(45) Date of Patent: Jun. 6, 2006

(54) DUAL-BAND ANTENNA FOR A WIRELESS LOCAL AREA NETWORK DEVICE

(75) Inventor: Nedim Erkocevic, Delfgauw (NL)

(73) Assignee: Agere Systems Inc., Allentown, PA (US)

( * ) Notice: Subject to any disclaimer, the term of this patent is extended or adjusted under 35 U.S.C. 154(b) by 16 days.

(21) Appl. No.: 10/696,852

(22) Filed: Oct. 30, 2003

(65) Prior Publication Data

US 2004/0222923 A1 Nov. 11, 2004

Related U.S. Application Data

(60) Provisional application No. 60/468,460, filed on May 7, 2003.

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 4,356,492 | A | 10/1982 | Kaloi | |
| 5,420,599 | A * | 5/1995 | Erkocevic | 343/828 |
| 5,859,614 | A | 1/1999 | Paolella et al. | |
| 6,100,848 | A * | 8/2000 | Hayes | 343/702 |
| 6,377,227 | B1 | 4/2002 | Zhu et al. | |
| 6,408,190 | B1 * | 6/2002 | Ying | 455/553.1 |
| 6,424,317 | B1 | 7/2002 | Rudish | |
| 6,515,629 | B1 * | 2/2003 | Kuo et al. | 343/700 MS |
| 6,529,168 | B1 * | 3/2003 | Mikkola et al. | 343/702 |
| 6,535,170 | B1 * | 3/2003 | Sawamura et al. | 343/702 |
| 6,567,048 | B1 * | 5/2003 | McKinzie et al. | 343/700 MS |
| 6,611,235 | B1 * | 8/2003 | Barna et al. | 343/702 |
| 6,614,400 | B1 * | 9/2003 | Egorov | 343/702 |
| 6,734,825 | B1 * | 5/2004 | Guo et al. | 343/700 MS |
| 6,795,028 | B1 * | 9/2004 | Stutzman et al. | 343/702 |
| 6,922,172 | B1 * | 7/2005 | Oshiyama et al. | 343/700 MS |
| 2002/0004125 | A1 * | 1/2002 | Ostrovsky | 428/220 |
| 2002/0019247 | A1 * | 2/2002 | Egorov | 455/557 |
| 2002/0175866 | A1 * | 11/2002 | Gram | 343/702 |
| 2002/0186169 | A1 * | 12/2002 | Iwai et al. | 343/702 |
| 2003/0001787 | A1 * | 1/2003 | Clifton | 343/702 |
| 2003/0207668 | A1 * | 11/2003 | McFarland et al. | 455/3.01 |
| 2004/0027288 | A1 * | 2/2004 | Okubora et al. | 343/700 MS |
| 2004/0198293 | A1 * | 10/2004 | Sadler et al. | 455/280 |
| 2004/0212545 | A1 * | 10/2004 | Li et al. | 343/866 |

FOREIGN PATENT DOCUMENTS

| | | | |
|---|---|---|---|
| EP | 0 986 130 | A2 * | 9/1999 |
| EP | 1 263 083 | A2 * | 12/2002 |

* cited by examiner

*Primary Examiner*—Tan Ho
*Assistant Examiner*—Leith Al-Nazer

(57) ABSTRACT

A dual-band antenna, a method of manufacturing the same and a wireless networking card incorporating the antenna. In one embodiment, the antenna includes: (1) a substrate, (2) an inverted F antenna printed circuit supported by the substrate and tuned to resonate in a first frequency band and (3) a monopole antenna printed circuit supported by the substrate, connected to the inverted F antenna printed circuit and tuned to resonate in a second frequency band.

35 Claims, 4 Drawing Sheets

DUAL-BAND ANTENNA FOR A WIRELESS LOCAL AREA NETWORK DEVICE

CROSS-REFERENCE TO RELATED APPLICATIONS

The present application is based on and claims priority of U.S. Provisional Patent Application Ser. No. 60/468,460, filed on May 7, 2003, by Erkocevic, entitled "Dual Band Printed Circuit Antenna for Wireless LANs," commonly assigned with the present application and incorporated herein by reference. The present application is also related to U.S. patent application Ser. No. 10/126,600, filed on Apr. 19, 2002, by Wielsma, entitled "Low-Loss Printed Circuit Board Antenna Structure and Method of Manufacture Thereof," commonly assigned with the present invention and incorporated herein by reference.

TECHNICAL FIELD OF THE INVENTION

The present invention is directed, in general, to multi-band antennas and, more specifically, to a dual-band antenna for a wireless local area network (WLAN) device.

BACKGROUND OF THE INVENTION

One of the fastest growing technologies over the last few years has been WLAN devices based on the Institute of Electrical and Electronic Engineers (IEEE) 802.11b standard, commonly known as "Wi-Fi." The 802.11b standard uses frequencies between 2.4 GHz and 2.5 GHz of the electromagnetic spectrum (the "2 GHz band") and allows users to transfer data at speeds up to 11 Mbit/sec.

However, a complementary WLAN standard is now coming into vogue. The IEEE 802.11a standard extends the 802.11b standard to frequencies between 5.2 GHz and 5.8 GHz (the "5 GHz band") and allows data to be exchanged at even faster rates (up to 54 Mbit/sec), but at a shorter operating range than does 802.11b.

IEEE 802.11g, which is on the horizon, is an extension to 802.11b. 802.11g still uses the 2 GHz band, but broadens 802.11b's data rates to 54 Mbps by using OFDM (orthogonal frequency division multiplexing) technology.

Given that the two popular WLAN standards involve two separate frequency bands, the 2 GHz band and the 5 GHz band, it stands to reason that WLAN devices capable of operating in both frequency bands should have more commercial appeal. In fact, it is a general proposition that WLAN devices should be as flexible as possible regarding the communications standards and frequency bands in which they can operate.

Dual-band transceivers and antennas lend WLAN devices the desired frequency band agility. Much attention has been paid to dual-band transceivers; however, dual-band transceivers are not the topic of the present discussion. Developing a suitable dual-band antenna has often attracted less attention. A dual-band antenna suitable for WLAN devices should surmount four significant design challenges.

First, dual-band antennas should be compact. While WLANs are appropriate for many applications, portable stations, such as laptop and notebook computers, personal digital assistants (PDAs) and WLAN-enabled cellphones, can best take advantage of the flexibility of wireless communication. Such stations are, however, size and weight sensitive. Second, dual-band antennas should be capable of bearing the bandwidth that its corresponding 802.11 standard requires. Third, dual-band antennas should attain its desired range as efficiently as possible. As previously described, WLAN devices are most often portable, meaning that they are often battery powered. Conserving battery power is a pervasive goal of portable devices. Finally, dual-band antennas should attain the first three design challenges as inexpensively as possible.

Accordingly, what is needed in the art is a dual-mode antenna that meets the challenges set forth above. More specifically, what is needed in the art is a dual-mode antenna suitable for IEEE 802.11a and 802.11b WLAN devices.

SUMMARY OF THE INVENTION

To address the above-discussed deficiencies of the prior art, the present invention provides a dual-band antenna, a method of manufacturing the same and a wireless networking card incorporating the antenna. In one embodiment, the antenna includes: (1) a substrate, (2) an inverted F antenna printed circuit supported by the substrate and tuned to resonate in a first frequency band and (3) a monopole antenna printed circuit supported by the substrate, connected to the inverted F antenna printed circuit and tuned to resonate in a second frequency band.

Another aspect of the present invention provides a wireless networking card, including: (1) wireless networking circuitry, (2) a dual-band transceiver coupled to the wireless networking circuitry and (3) a dual-band antenna coupled to the dual-band transceiver and including: (3a) a substrate, (3b) an inverted F antenna printed circuit supported by the substrate and tuned to resonate in a first frequency band and (3c) a monopole antenna printed circuit supported by the substrate, connected to the inverted F antenna printed circuit and tuned to resonate in a second frequency band.

Yet another aspect of the present invention provides a method of manufacturing a dual-band antenna, including: (1) forming an inverted F antenna printed circuit on a substrate, the inverted F antenna printed circuit tuned to resonate in a first frequency band and (2) forming a monopole antenna printed circuit on the substrate, the monopole antenna connected to the inverted F antenna printed circuit and tuned to resonate in a second frequency band.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
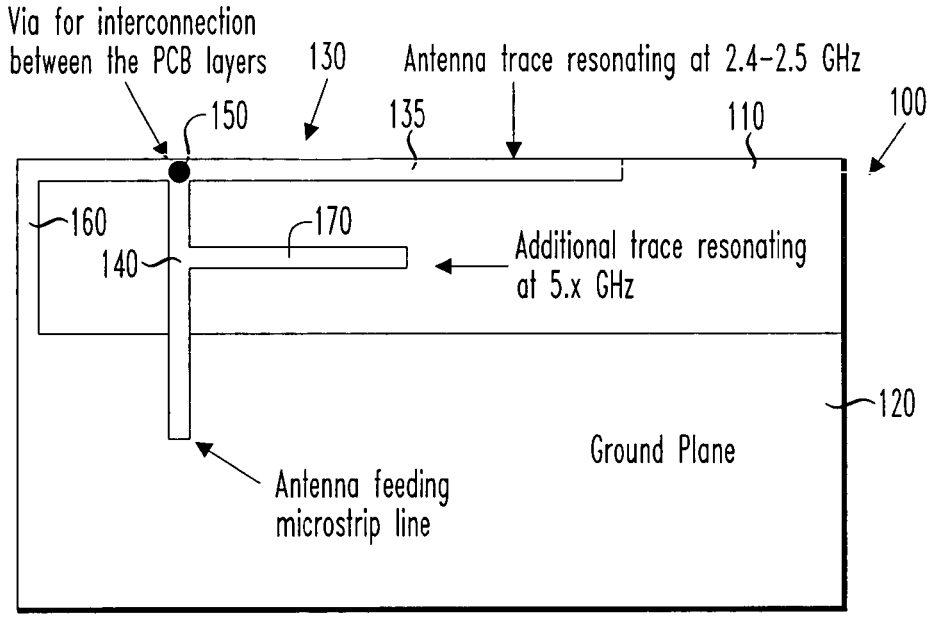
FIG. 1 illustrates a plan view of a first embodiment of a dual-band antenna constructed according to the principles of the present invention.

Referring initially to FIG. 1, illustrated is a plan view of a first embodiment of a dual-band antenna constructed according to the principles of the present invention.

The dual-band antenna, generally designated 100, is supported by a substrate 110. The substrate 110 can be any suitable material. If cost is less of an object, the substrate 110 can be composed of a low-loss material (i.e., a material that does not significantly attenuate proximate electromagnetic fields, including those produced by the dual-band antenna 100). If cost is more of an object, the substrate 110 can be formed from a more conventional higher loss, or "lossy," material such as FR-4 PCB, which is composed of fiberglass and epoxy. However, as Wielsma, supra, describes, such "lossy" materials can compromise antenna range by absorbing energy that would otherwise contribute to the electromagnetic field produced by the dual-band antenna 100. Wielsma teaches that antenna range can be substantially preserved even with such "lossy" materials by providing lower-loss regions in the "lossy" substrate. These lower-loss regions may simply be holes in the substrate or may be composed of ceramic or polytetraf luoroethylene (PTFE), commonly known as Teflon®. The present invention encompasses the use of either low-loss or "lossy" materials either with or without such lower-loss regions.

The embodiment of the dual-band antenna 100 illustrated in FIG. 1 spans both upper and lower (i.e., "opposing") surfaces (different planes) of the substrate 110. It is often the case that the lower surface of a substrate employed as a wireless networking card is largely occupied with a ground plane 120. The upper surface of the substrate 110 (and interior layers, also different planes, if such are used) are occupied with various printed circuit traces (not shown) that route power and signals among the various components that constitute wireless networking circuitry (also not shown). Because the dual-band antenna 100 of the present invention is a printed circuit antenna, the traces further define the printed circuits that constitute the dual-band antenna 100.

The dual-band antenna 100 includes an inverted F antenna printed circuit 130. Inverted F antennas in general have three parts: a radiator, a feed line and a ground line or ground plane. The ground plane 120 serves as the ground plane for the inverted F antenna printed circuit 130.

The inverted F antenna printed circuit 130 is illustrated as including a radiator 135 located on the lower surface of the substrate 110 apart from the ground plane 120. The radiator 135 is tuned to resonate in a first frequency band. In an alternative (and more power-efficient) embodiment, the radiator 135 is located on both the upper and lower surface of the substrate 110.

In the illustrated embodiment, this first frequency band is between about 2.4 GHz and about 2.5 GHz (the 2 GHz band). Those skilled in the art understand how inverted F antennas may be formed of printed circuit traces, are configured to resonate in a desired frequency band and further that the inverted F antenna printed circuit 130 of the present invention may be modified to resonate in any reasonable desired frequency band.

A feed line 140 is located on the upper surface of the substrate 110 and couples the radiator 135 to wireless networking circuitry (not shown in FIG. 1) by way of a conductive interconnection 150 (e.g., a via containing a conductor). A ground line 160 extends from the radiator 135 to the ground plane 120. In the illustrated embodiment, the feed line 140 and the ground line 160 take the forms of traces.

Those skilled in the pertinent art understand that a trace proximate a ground line or plane does not effectively radiate as an antenna. Only when the trace is separated from the ground line or plane does the trace radiate as an antenna.

The dual-band antenna 100 further includes a monopole antenna printed circuit 170. The monopole antenna printed circuit 170 is located on the upper surface of the substrate 110 outside of ("without") a footprint of the ground plane 120, is connected to the feed line 140 and is tuned to resonate in a second frequency band. In the illustrated embodiment, this second frequency band is between about 5.2 GHz and about 5.8 GHz (the 5 GHz band). Those skilled in the art understand how monopole antennas may be formed of printed circuit traces, are configured to resonate in a desired frequency band and further that the monopole antenna printed circuit 170 of the present invention may be modified to resonate in any reasonable desired frequency band, including a frequency band that is higher than the first frequency band.

Those skilled in the art understand that the inverted F and monopole antenna printed circuits 130, 170 should be combined such that they each present a desired impedance when operating in their respective bands. In the illustrated embodiment, that impedance is about 50 ohms. The impedance can be varied, however, without departing from the broad scope of the present invention. Further, an impedance matching circuit (not shown) may be employed with the inverted F and monopole antenna printed circuits 130, 170 to compensate for any mismatch therein.

It is apparent that the above-described and illustrated dual-band antenna 100 is compact. It is located on the same substrate as its associated wireless networking circuitry (not shown). The antenna 100 is a power-efficient design, it is neither compromised in terms of its range nor wasteful of battery resources. Because it uses printed circuits to advantage, the antenna 100 is relatively inexpensive. Thus, the first embodiment of the dual-band antenna 100 meets at least three of the four design challenges set forth in the Background of the Invention section above. If the bandwidth capability of the antenna 100 is inadequate in the 5 GHz band, however, further embodiments to be described with reference to FIGS. 2 and 3 are in order.

Figure 2:
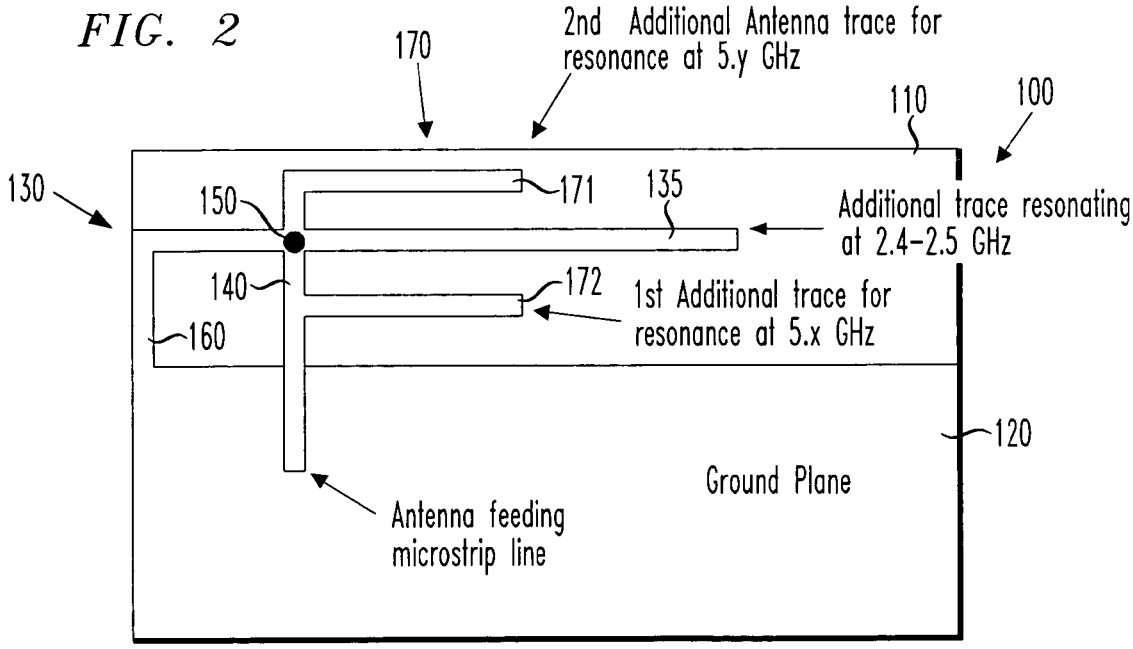
FIG. 2 illustrates a plan view of a second embodiment of a dual-band antenna constructed according to the principles of the present invention.

Turning now to FIG. 2, illustrated is a plan view of a second embodiment of a dual-band antenna constructed according to the principles of the present invention. This second embodiment is in many ways like the first embodiment of FIG. 1, except that the monopole antenna printed circuit 170 has been divided into first and second traces 171, 172 tuned to differing resonance in the second frequency band. The first and second traces 171, 172 cooperate to enable the monopole antenna printed circuit 170 to attain a higher bandwidth. As is apparent in FIG. 2, a footprint of the radiator 135 of the inverted F antenna printed circuit 130 lies between footprints of the first and second traces 171, 172 of the monopole antenna printed circuit 170. Of course, the footprint of the radiator 135 can lie outside of the footprints of the first and second traces 171, 172 of the monopole antenna printed circuit 170. In fact, an example of this embodiment is illustrated in FIG. 3.

Figure 3:
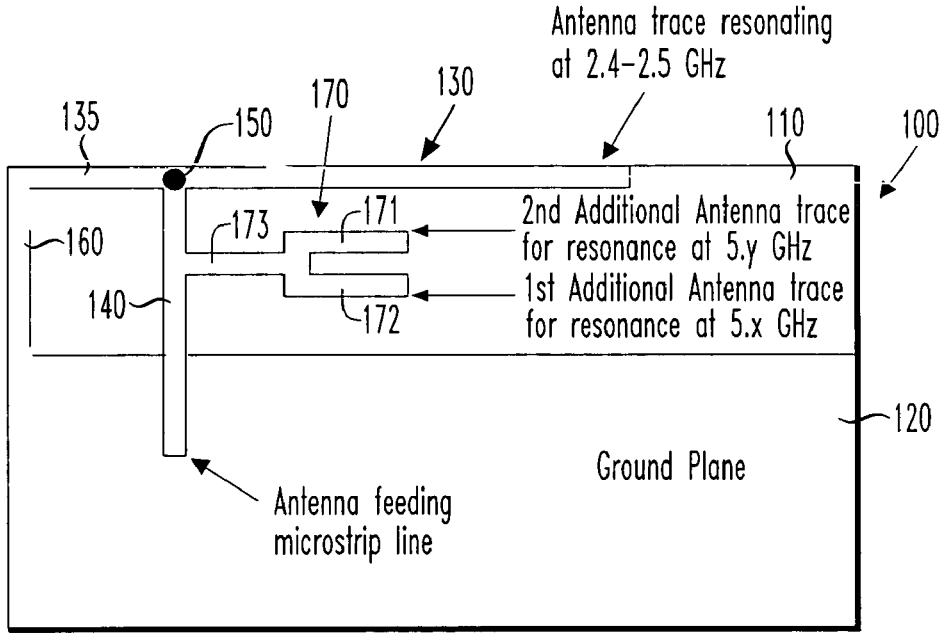
FIG. 3 illustrates a plan view of a third embodiment of a dual-band antenna constructed according to the principles of the present invention.

Turning now to FIG. 3, illustrated is a plan view of a third embodiment of a dual-band antenna constructed according to the principles of the present invention. As stated above, this third embodiment of the dual-band antenna 100 calls for the footprint of the radiator 135 of the inverted F antenna printed circuit 130 to lie outside of the footprints of the first and second traces 171, 172 of the monopole antenna printed circuit 170. The monopole antenna printed circuit 170 has been further modified to introduce a root trace 173 from which the first and second traces 171, 172 extend. The root trace 173 serves to reduce the amount of conductive material required to form the monopole antenna printed circuit 170.

Those skilled in the pertinent art will see that the first, second and third embodiments of FIGS. 1, 2 and 3 are but a few of the many variants that fall within the broad scope of the present invention. Dimensions, materials, shapes, frequencies, numbers of antennas and traces and numbers of substrate layers, for example, can be changed without departing from the present invention.

Figure 4:
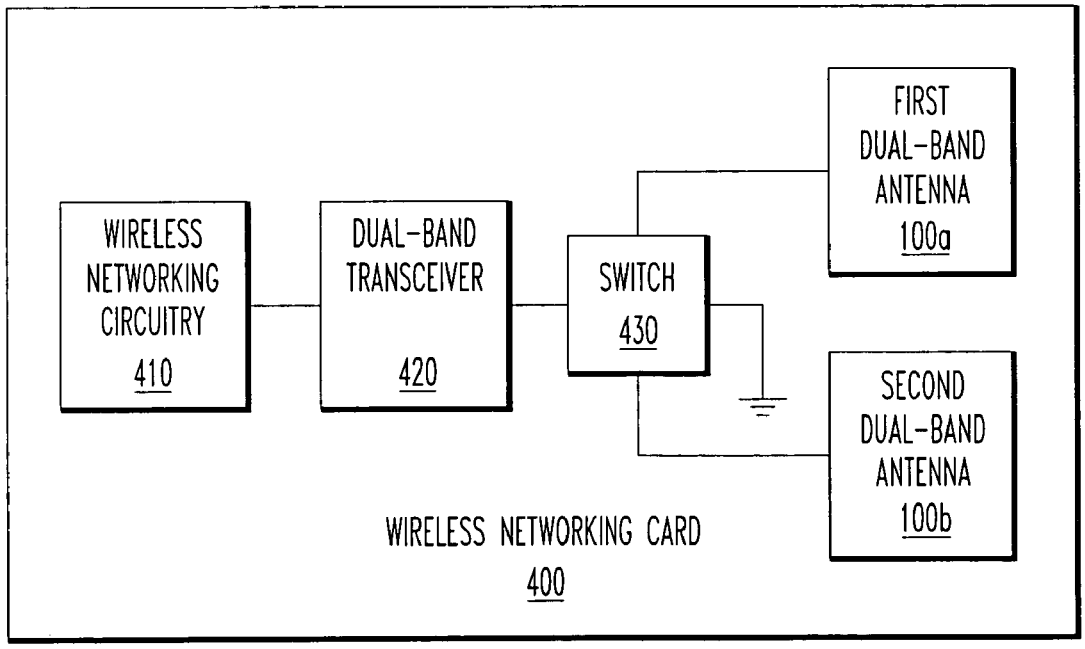
FIG. 4 illustrates a block diagram of one embodiment of a wireless networking card constructed according to the principles of the present invention.

Turning now to FIG. 4, illustrated is a block diagram of one embodiment of a wireless networking card constructed according to the principles of the present invention.

The wireless networking card, generally designated 400, includes wireless networking circuitry 410. The wireless networking circuitry 410 may be of any conventional or later-developed type.

The wireless networking card 400 further includes a dual-band transceiver 420. The dual-band transceiver 420 is coupled to the wireless networking circuitry 410 and may operate at any combination of bands. However, the particular dual-band transceiver 420 of the embodiment illustrated in FIG. 4 operates in accordance with the IEEE 802.11a, 802.11b and 802.11g standards (so-called "802.11a/b/g").

The wireless networking card 400 further includes a first dual-band antenna 100*a* and an optional second dual-band antenna 100*b*. For the purpose of antenna diversity, an optional switch 430 connects one of the dual-band antennas (e.g., the first dual-band antenna 100*a*) to the dual-band transceiver 420. The switch 430 also connects the non-selected dual-band antenna (e.g., the second dual-band antenna 100*b*) to ground (e.g., the ground plane 120 of FIGS. 1, 2 or 3) to reduce RF coupling between the selected and the non-selected dual-band antenna. Further information on grounding the non-selected antenna can be found in U.S. Pat. No. 5,420,599 to Erkocevic, which is incorporated by reference.

The first dual-band antenna 100*a* and the optional second dual-band antenna 100*b* may be configured according to the first, second or third embodiments of FIG. 1, 2 or 3, respectively, or of any other configuration that falls within the broad scope of the present invention.

Figure 5:
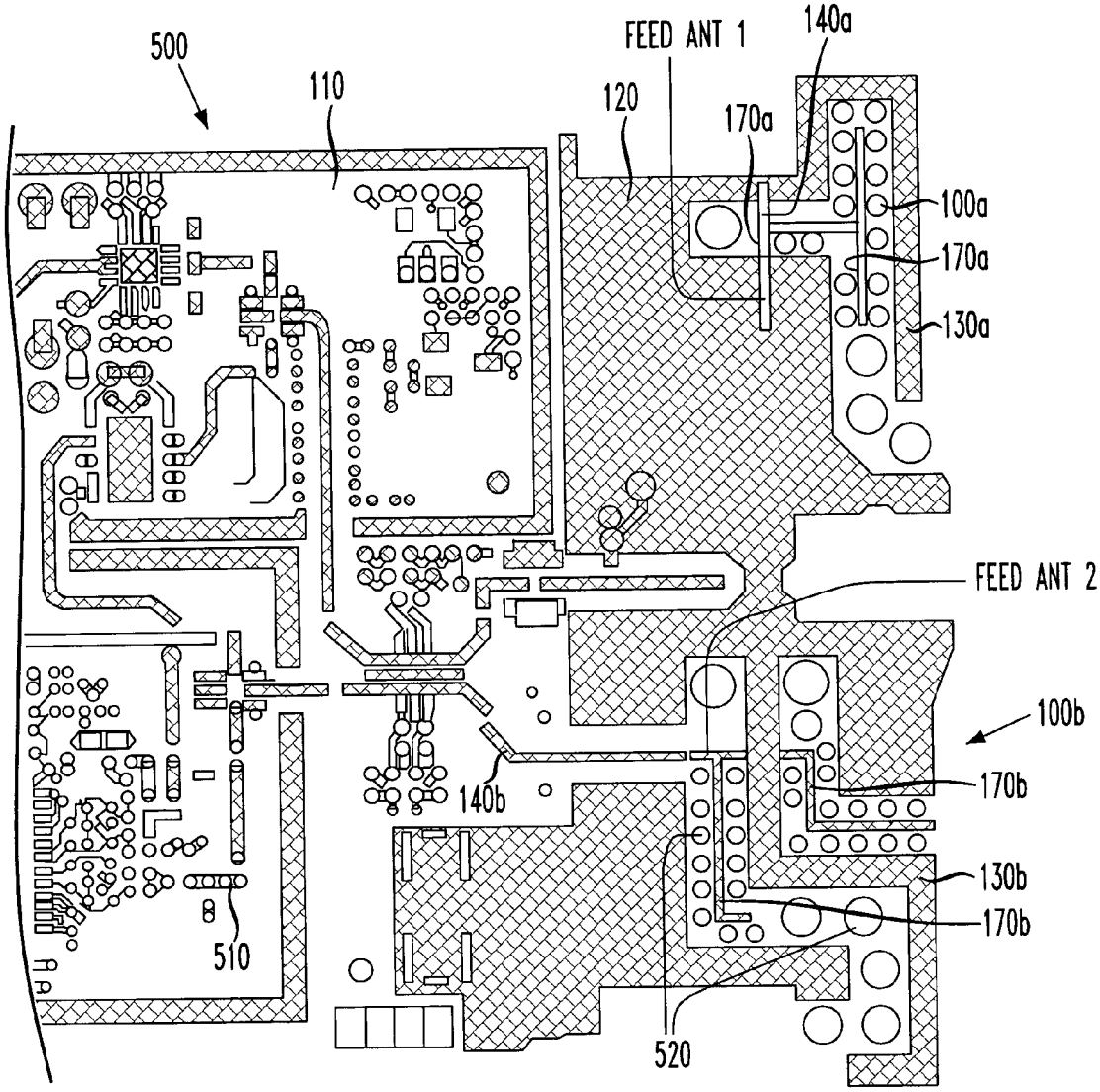
FIG. 5 illustrates a plan view of one embodiment of a circuit board for a wireless networking card that includes multiple dual-band antennas constructed according to the principles of the present invention.

Turning now to FIG. 5, illustrated is a plan view of one embodiment of a circuit board for a wireless networking card that includes multiple dual-band antennas constructed according to the principles of the present invention.

The circuit board, generally designated 500, includes a substrate 110 composed of a "lossy" material and having a ground plane 120. Various printed circuit traces 510 route power and signals among the various components that constitute wireless networking circuitry (not shown, but that would be mounted on the circuit board 500). Lower loss regions (holes in the illustrated embodiment) are located in the circuit board 500 proximate the dual-band antenna 100. One lower loss region is designated 520 as an example. The function of the lower loss regions is explained above.

The circuit board 500 includes two dual-band antennas 100*a*, 100*b* positioned mutually with respect to one another to optimize antenna diversity. The circuit board 500 also supports a switch (not shown, but that would be mounted on the circuit board 500) that connects the selected one of the dual-band antennas (e.g., 100*a*) to the wireless networking circuitry. As previously stated, the switch can also connect the non-selected dual-band antenna (e.g., 100*b*) to the ground plane 120 to reduce RF coupling between the selected and the non-selected dual-band antenna.

The first dual-band antenna 100*a* includes a first inverted F antenna printed circuit 130*a* tuned to resonate in a first frequency band, a monopole antenna printed circuit 170*a* and a first feed line 140*a* coupling the first inverted F and monopole antenna printed circuits 130*a*, 170*a* to the wireless networking circuitry (not shown).

The second dual-band antenna 100*b* includes a second inverted F antenna printed circuit 130*b* tuned, for diversity purposes, to resonate in the first frequency band, a monopole antenna printed circuit 170*b* and a second feed line 140*b* coupling the second inverted F and monopole antenna printed circuits 130*b*, 170*b* to the wireless networking circuitry (not shown). Conductive interconnections and ground lines for the first and second dual-band antennas 100*a*, 100*b* are shown but not referenced for simplicity's sake.

Figure 6:
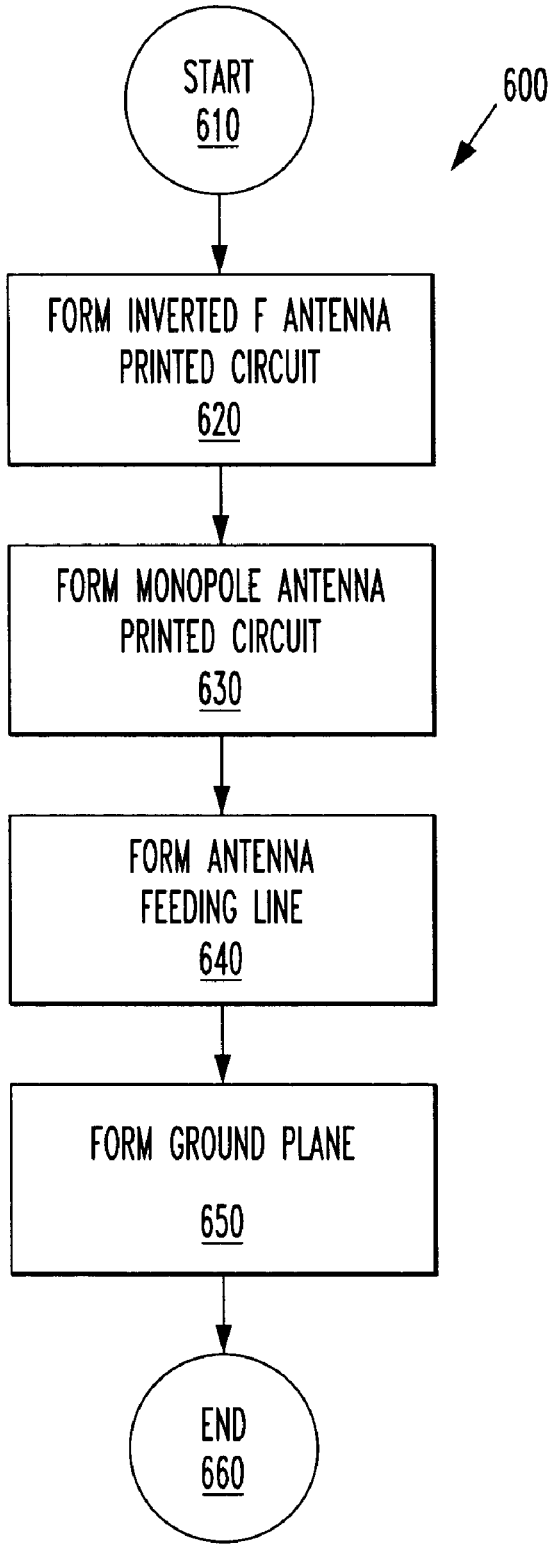
FIG. 6 illustrates a flow diagram of one embodiment of a method of manufacturing a dual-band antenna carried out according to the principles of the present invention.

Turning now to FIG. 6, illustrated is a flow diagram of one embodiment of a method of manufacturing a dual-band antenna carried out according to the principles of the present invention.

The method, generally designated 600, begins in a start step 610, wherein it is desired to manufacturing a dual-band antenna. The method 600 proceeds to a step 620 in which an inverted F antenna printed circuit is formed on a suitable substrate. The inverted F antenna printed circuit is tuned to resonate in a first frequency band (e.g., the 2 GHz band). Next, in a step 630, a monopole antenna printed circuit is formed on the substrate. The monopole antenna is connected to the inverted F antenna printed circuit and tuned to resonate in a second frequency band (e.g., the 5 GHz band). The monopole antenna printed circuit may include first and second traces tuned to differing resonance and may further include a root trace from which the first and second traces extend. The footprint of the inverted F antenna printed circuit may or may not lie between footprints of the first and second traces, if the monopole antenna printed circuit includes them.

Then, in a step 640, a feed line is formed on the substrate and connected to the inverted F and monopole antenna printed circuits. One or more conductive interconnections may be required to connect the feed line to the inverted F and monopole antenna printed circuits. Next, in a step 650, a ground plane is formed on the substrate. The ground plane is coupled to and spaced apart from both the inverted F antenna printed circuit and the monopole antenna printed circuit. The method 600 ends in an end step 660.

It should be understood that, since the ground plane and the printed circuits, traces and root are all printed circuit conductors, they can be formed concurrently. It is typical to form a layer of conductive material at a time. Thus, in forming a circuit board having upper and lower layers, all printed circuit conductors on a particular layer would probably be formed concurrently, such that the method 600 is carried out in two formation steps.

Although the present invention has been described in detail, those skilled in the art should understand that they can make various changes, substitutions and alterations herein without departing from the spirit and scope of the invention in its broadest form.

What is claimed is:

1. A dual-band antenna, comprising:

a substrate;

an inverted F antenna printed circuit supported by said substrate and tuned to resonate in a first frequency band, said inverted F antenna having a ground plane; and a monopole antenna printed circuit supported by said substrate and located on a different plane than said ground plane, said monopole antenna printed circuit tuned to resonate in a second frequency band and indirectly connected to said ground plane via said inverted F antenna.

2. The antenna as recited in claim 1 further comprising a feed line located on a different plane of said substrate from a radiator of said inverted F antenna printed circuit and said monopole antenna printed circuit is coupled to said feed line.

3. The antenna as recited in claim 1 further comprising a feed line located on one surface of said substrate, said antenna further comprising a conductive interconnection coupling said feed line to a radiator of said inverted F antenna printed circuit located on an opposing surface of said substrate.

4. The antenna as recited in claim 1 wherein said ground plane is coupled to and spaced apart from both a radiator of said inverted F antenna printed circuit and said monopole antenna printed circuit.

5. The antenna as recited in claim 1 wherein said monopole antenna printed circuit comprises first and second traces tuned to differing resonance in said second frequency band.

6. The antenna as recited in claim 5 wherein said monopole antenna printed circuit further comprises a root trace from which said first and second traces extend.

7. The antenna as recited in claim 5 wherein a footprint of a radiator of said inverted F antenna printed circuit lies between footprints of said first and second traces.

8. The antenna as recited in claim 1 wherein said substrate is composed of a higher loss material and has a plurality of lower loss regions located proximate a radiator of said inverted F antenna printed circuit and said monopole antenna printed circuit.

9. The antenna as recited in claim 1 wherein said first frequency band is lower than said second frequency band.

10. The antenna as recited in claim 9 wherein said first frequency band is between about 2.4 GHz and about 2.5 GHz and said second frequency band is between about 5.2 GHz and about 5.8 GHz.

11. A wireless networking card, comprising:

wireless networking circuitry;

a dual-band transceiver coupled to said wireless networking circuitry; and a dual-band antenna coupled to said dual-band transceiver and including:

a substrate, an inverted F antenna printed circuit supported by said substrate and tuned to resonate in a first frequency band, said inverted F antenna having a ground plane, and a monopole antenna printed circuit supported by said substrate and located on a different plane than said ground plane, said monopole antenna printed circuit tuned to resonate in a second frequency band and indirectly connected to said ground plane via said inverted F antenna.

12. The wireless networking card as recited in claim 11 further comprising a feed line located on a different plane of said substrate from a radiator of said inverted F antenna printed circuit and said monopole antenna printed circuit is coupled to said feed line.

13. The wireless networking card as recited in claim 11 further comprising a feed line located on one surface of said substrate, said antenna further comprising a conductive interconnection coupling said feed line to a radiator of said inverted F antenna printed circuit located on an opposing surface of said substrate.

14. The wireless networking card as recited in claim 11 wherein said ground plane is coupled to and spaced apart from both a radiator of said inverted F antenna printed circuit and said monopole antenna printed circuit.

15. The wireless networking card as recited in claim 11 wherein said monopole antenna printed circuit comprises first and second traces tuned to differing resonance in said second frequency band.

16. The wireless networking card as recited in claim 15 wherein said monopole antenna printed circuit further comprises a root trace from which said first and second traces extend.

17. The wireless networking card as recited in claim 15 wherein a footprint of a radiator of said inverted F antenna printed circuit lies between footprints of said first and second traces.

18. The wireless networking card as recited in claim 11 wherein said substrate is composed of a higher loss material and has a plurality of lower loss regions located proximate a radiator of said inverted F antenna printed circuit and said monopole antenna printed circuit.

19. The wireless networking card as recited in claim 11 wherein said first frequency band is lower than said second frequency band.

20. The wireless networking card as recited in claim 19 wherein said first frequency band is between about 2.4 GHz and about 2.5 GHz and said second frequency band is between about 5.2 GHz and about 5.8 GHz.

21. The wireless networking card as recited in claim 11 further comprising a second dual-band antenna coupled to said dual-band transceiver.

22. The wireless networking card as recited in claim 21 further comprising a switch that selectively connects one of said first dual-band antenna and said second dual-band antenna to said dual-band transceiver and connects another of said first dual-band antenna and said second dual-band antenna to ground.

23. A method of manufacturing a dual-band antenna, comprising:

forming an inverted F antenna printed circuit on a substrate, said inverted F antenna printed circuit having a ground plane and tuned to resonate in a first frequency band; and forming a monopole antenna printed circuit on said substrate and on a different plane than said ground plane, said monopole antenna printed circuit tuned to resonate in a second frequency band and connected indirectly to said ground plane via said inverted F antenna.

24. The method as recited in claim 23 further comprising forming a feed line on a different plane of said substrate from a radiator of said inverted F antenna printed circuit and coupling said monopole antenna printed circuit to said feed line.

25. The method as recited in claim 23 further comprising forming a feed line on one surface of said substrate and forming a conductive interconnection to couple said feed line to a radiator of said inverted F antenna printed circuit located on an opposing surface of said substrate.

26. The method as recited in claim 23 wherein said ground plane is coupled to and spaced apart from both a radiator of said inverted F antenna printed circuit and said monopole antenna printed circuit.

27. The method as recited in claim 23 wherein said monopole antenna printed circuit comprises first and second traces tuned to differing resonance in said second frequency band.

28. The method as recited in claim 27 wherein said monopole antenna printed circuit further comprises a root trace from which said first and second traces extend.

29. The method as recited in claim 27 wherein a footprint of a radiator of said inverted F antenna printed circuit lies between footprints of said first and second traces.

30. The method as recited in claim 23 wherein said substrate is composed of a higher loss material and has a plurality of lower loss regions located proximate a radiator of said inverted F antenna printed circuit and said monopole antenna printed circuit.

31. The method as recited in claim 23 wherein said first frequency band is lower than said second frequency band.

32. The method as recited in claim 31 wherein said first frequency band is between about 2.4 GHz and about 2.5 GHz and said second frequency band is between about 5.2 GHz and about 5.8 GHz.

33. A dual-band antenna, comprising:

a substrate;

an inverted F antenna printed circuit supported by said substrate and tuned to resonate in a first frequency band;

a feed line located on a different plane of said substrate from a radiator of said inverted F antenna printed circuit; and a monopole antenna printed circuit, coupled to said inverted F antenna printed circuit and said feed line, said monopole antenna printed circuit supported by said substrate and tuned to resonate in a second frequency band.

34. A dual-band antenna, comprising:

a substrate;

an inverted F antenna printed circuit supported by said substrate and tuned to resonate in a first frequency band;

a feed line located on one surface of said substrate;

a conductive interconnection coupling said feed line to a radiator of said inverted F antenna printed circuit located on an opposing surface of said substrate; and a monopole antenna printed circuit supported by said substrate, connected to said inverted F antenna printed circuit and tuned to resonate in a second frequency band.

35. A dual-band antenna, comprising:

a substrate;

an inverted F antenna printed circuit supported by said substrate and tuned to resonate in a first frequency band; and a monopole antenna printed circuit supported by said substrate, connected to said inverted F antenna printed circuit and tuned to resonate in a second frequency band, said monopole antenna printed circuit including a first trace directly coupled to a second trace and each trace tuned to differing resonance in said second frequency band.

* * * * *